US007302737B2

(12) United States Patent
Bae

(10) Patent No.: US 7,302,737 B2
(45) Date of Patent: Dec. 4, 2007

(54) BALL TYPE CABLE TIE HAVING RELEASE PREVENTION TONGUE

(75) Inventor: Jun-Jip Bae, Seoul (KR)

(73) Assignee: Dong-A Bestech Co., Ltd., Buchon (KR)

( * ) Notice: Subject to any disclaimer, the term of this patent is extended or adjusted under 35 U.S.C. 154(b) by 59 days.

(21) Appl. No.: 11/248,154

(22) Filed: Oct. 13, 2005

(65) Prior Publication Data

US 2006/0200949 A1 Sep. 14, 2006

(30) Foreign Application Priority Data

Mar. 10, 2005 (KR) ..... 10-2005-0020288

(51) Int. Cl.
*F16L 33/00* (2006.01)
*B65D 63/02* (2006.01)

(52) U.S. Cl. ..... 24/25; 24/21; 24/20 EE; 24/115 L; 24/136 A; 24/20 R

(58) Field of Classification Search ..... 24/25, 24/21, 20 EE, 115 L, 136 A, 20 R
See application file for complete search history.

(56) References Cited

U.S. PATENT DOCUMENTS 4,366,602 A * 1/1983 Conlon et al. ..... 24/25
4,399,592 A * 8/1983 Chopp et al. ..... 24/25
5,291,637 A * 3/1994 Meyers ..... 24/25
5,732,446 A * 3/1998 Blanks ..... 24/25
6,647,596 B1 11/2003 Caveney
6,668,427 B2 * 12/2003 Bulanda et al. ..... 24/25

* cited by examiner

*Primary Examiner*—Katherine Mitchell
*Assistant Examiner*—Marcus Menezes
(74) *Attorney, Agent, or Firm*—Kratz, Quintos & Hanson, LLP

(57) ABSTRACT

A cable tie comprises a band-shaped strap which has a fixed end, formed in the shape of a hook, and a free end, a locking head which is secured to the fixed end of the strap and through which the free end of the strap passes, and a locking ball which is disposed in the locking head so as to be movable forward and rearward, wherein the width between upper and lower portions of the fixed end of the strap is established to be slightly greater than the thickness of the bottom wall of the locking head, a release prevention tongue is cut in the upper portion of the fixed end of the strap and is integrated with the strap, a distal end of the release prevention tongue is bent downward, and the locking ball is guided in a rearward locking direction and is elastically supported upward.

3 Claims, 4 Drawing Sheets

BALL TYPE CABLE TIE HAVING RELEASE PREVENTION TONGUE

BACKGROUND OF THE INVENTION

1. Field of the Invention

The present invention relates, in general, to a ball type cable tie having a release prevention tongue, and, more particularly, to a ball type cable tie having a release prevention tongue, wherein a release prevention tongue is formed on the upper portion of the fixed end of a strap which is coupled at the fixed end to a locking head, to doubly secure the locking head to the strap and to maintain the locking head in a reliably secured state, thereby decreasing a defective proportion of end products, and wherein a locking ball is guided in a rearward locking direction and pushed upward by elastic support action of the release prevention tongue which elastically operates, to prevent the locked state of the cable tie from being released and to maintain a tightly bundled state of the cable tie, thereby increasing the strength of the strap and improving the durability of the cable tie.

2. Description of the Prior Art

Generally, cable ties are widely used to bundle elongate objects such as electric wires of an electronic apparatus, cables of a ship, etc. Among such cable ties, a ball type cable tie is most widely used, in which a locking ball is moved forward and rearward to lock a strap. A ball type cable tie is disclosed in U.S. Pat. No. 4,399,592. This ball type cable tie has a structure in which the free end of a strap, having been threaded through a locking head, pushes a locking ball in a rearward locking direction, and a protrusion is formed to prevent the locking ball from being moved forward and the strap from thus becoming unlocked. However, in this type of cable tie, since the locking head and the fixed end of the strap are coupled to each other through the introduction of a latching finger projecting at an angle from the lower portion of the fixed end into a window defined in the bottom wall of the locking head, in the case that the latching finger is not bent or is bent below a predetermined height when manufacturing the strap, the locking head can be easily released from the strap, which inconveniences a user. Also, if the protrusion is crushed by the locking ball which is moved forward due to excessive load, the locked state of the strap is likely to be released.

In order to cope with these problems, a ball lock cable tie having a strap aperture is disclosed in U.S. Pat. No. 6,647,596. In this ball lock cable tie, an aperture is defined in the upper portion of the fixed end of a strap so that a locking ball can deform the threaded portion of the strap in the aperture to increase the locking strength of the cable tie. Nevertheless, even in this ball lock cable tie, since the locking head and the fixed end of the strap are coupled to each other through the introduction of a latching finger projecting at an angle from the lower portion of the fixed end into a window defined in the bottom wall of the locking head, in the case that the latching finger is not bent or is bent below a predetermined height when manufacturing the strap, it is difficult to prevent the release of the locking head from the strap. Further, because the aperture is defined in the strap, the strength of the strap itself is decreased, as a result of which the strap cannot stand substantial tensile force and is likely to break.

SUMMARY OF THE INVENTION

Accordingly, the present invention has been made keeping in mind the above problems occurring in the prior art, and an object of the present invention is to provide a ball type cable tie having a release prevention tongue, in which a locking head is reliably secured to a strap and prevented from being released.

Another object of the present invention is to provide a ball type cable tie having a release prevention tongue, in which a locking head is prevented from becoming uncoupled from a strap and a locking ball is guided in a rearward locking direction and is elastically supported upward to reliably ensure the locked state of the cable tie and reinforce the strength of the strap.

In order to achieve the above objects, according to the present invention, there is provided a cable tie comprising a band-shaped elongate strap, a locking head secured to a fixed end of the strap, and a locking ball positioned between the locking head and the strap, wherein a window is defined in the bottom wall of the locking head and a release prevention tongue is partially cut and project at an angle from an upper portion of the fixed end of the strap.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
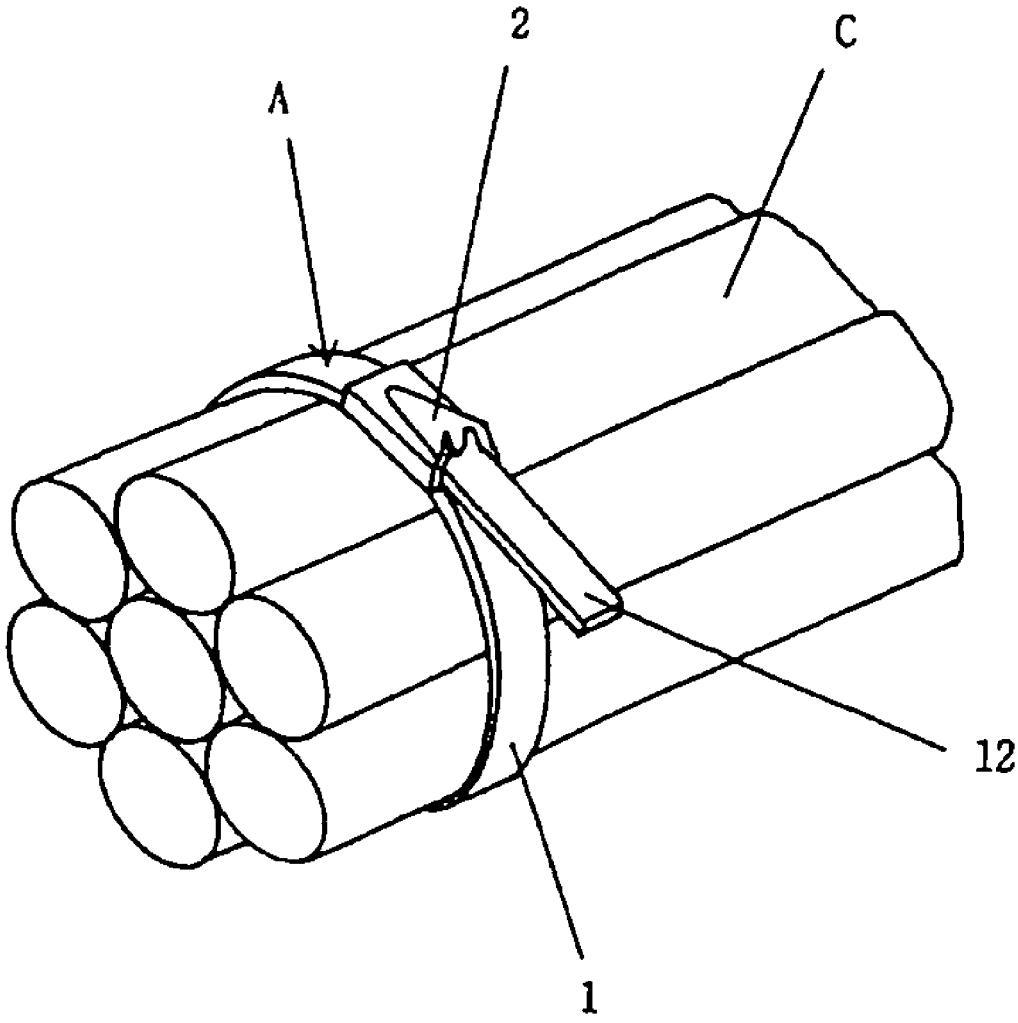
FIG. 1 is a perspective view illustrating cables bundled using a cable tie in accordance with a preferred embodiment of the present invention.
Figure 2:
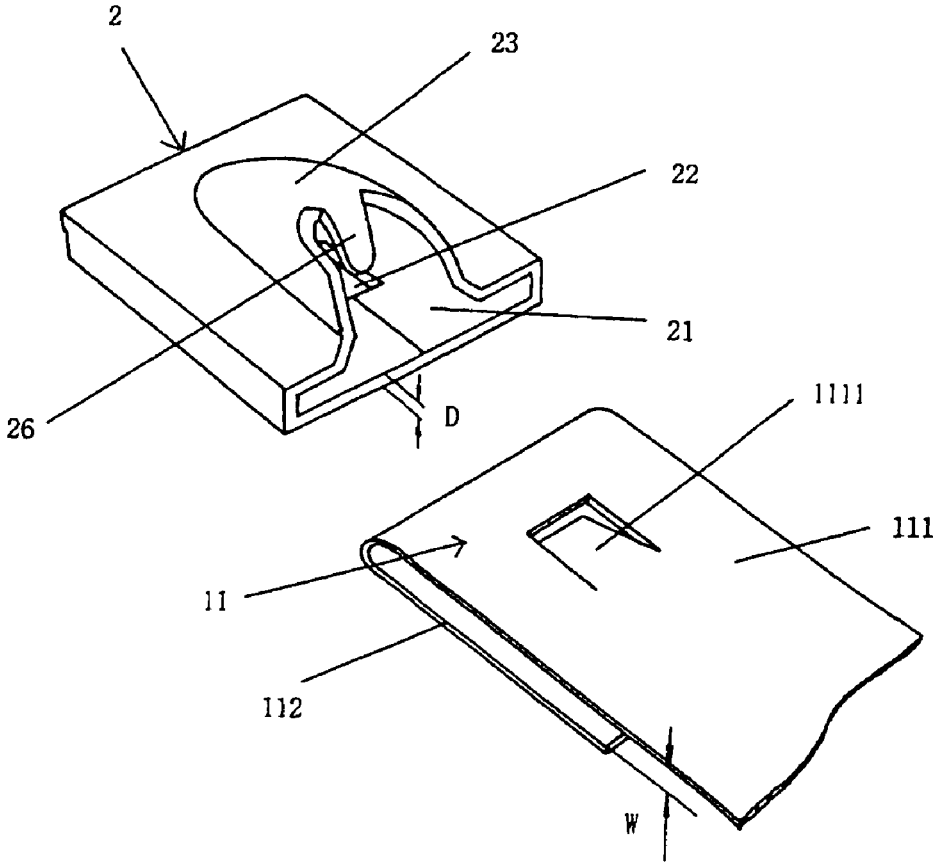
FIG. 2 is an exploded perspective view of the cable tie according to the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 3A:
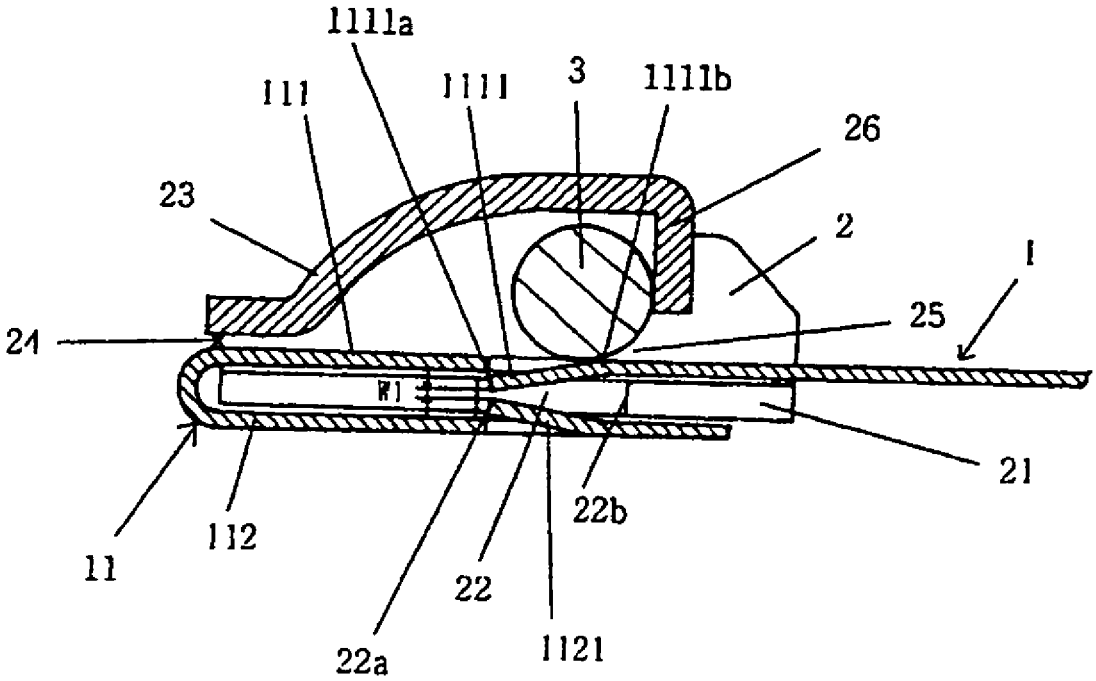
FIGS. 3*a* and 3*b* are enlarged longitudinal sectional views illustrating a head part of the cable tie according to the present invention.
Figure 3B:
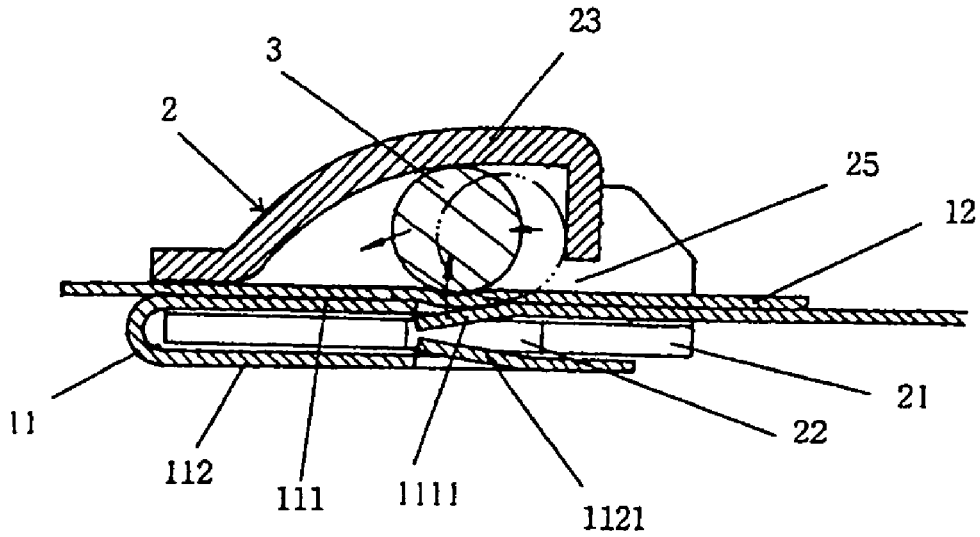

Referring to FIG. 1, a cable tie A in accordance with a preferred embodiment of the present invention is illustrated in a state in which it bundles a plurality of cables C. As shown in FIGS. 3*a* and 3*b*, the cable tie A comprises a band-shaped strap 1 which has a fixed end 11 formed in the shape of a hook and a free end 12, a locking head 2 which is secured to the fixed end 11 of the strap 1 and through which the free end 12 of the strap 1 passes, and a locking ball 3 which is disposed in the locking head 2 to be moved forward and rearward. The fixed end 11 of the strap 1 is bent in the shape of a hook. The width W of a space defined between upper and lower portions 111 and 112 of the fixed end 11 of the strap 1 which has the hook-shaped configuration is established to be slightly greater than the thickness D of the bottom wall 21 of the locking head 2.

The bottom wall 21 of the locking head 2 is defined with a window 22, and a latching finger 1121 which is formed on the lower portion 112 of the fixed end 11 of the strap 1 projects upward into the window 22.

A ball guide projection 23, which is inclined downward toward a strap entrance 24 to allow the locking ball 3 to be moved forward and rearward, is formed on the locking head 2. An engagement arm 26 is formed at the rear end of the ball guide projection 23, at which a strap exit 25 is defined, to prevent release of the locking ball 3 from the locking head 2.

Figure 4:
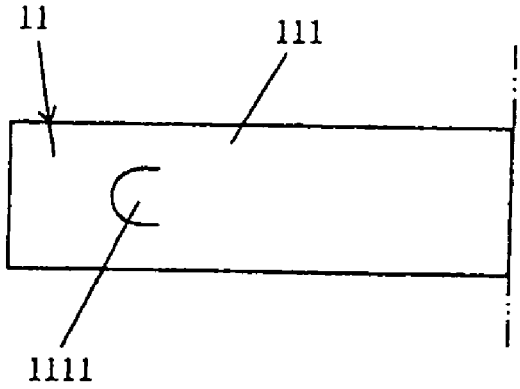
FIG. 4 is a plan view illustrating a fixed end of a strap according to a variation of the present invention.

A release prevention tongue 1111 is cut in the upper portion 111 of the fixed end 11 of the strap 1 and is integral with the strap 1, and the proximal end 1111*b* of the release prevention tongue 1111 is bent downward. The distal end 1111*a* of the release prevention tongue 1111, which is bent downward toward the strap entrance 24, is introduced into the window 22 of the locking head 2 and thus is capable of colliding against an inner rear wall 22*a* of the locking head 2 which defines the window 22. While, in the present embodiment, the release prevention tongue 111 is formed to have a quadrangular configuration which is cut toward the strap entrance 24, the present invention is not limited to such a configuration, and the release prevention tongue may be formed to have a rounded configuration shown in FIG. 4 or a triangular configuration. The distal end 1111*a* of the release prevention tongue 111 serves as a free end and the proximal end 1111*b* of the release prevention tongue 111 serves as a fixed end. Therefore, as the release prevention tongue 1111 applies elastic force upward, excessive deformation of the strap 1 which is inserted into the locking head 2 is prevented, and the locking ball 3 is supported upward, whereby the locked state of the cable tie 1 can be reliably maintained. The release prevention tongue 1111 has a length and a width which are less than those of the window 22 of the locking head 2. Due to the fact that the release prevention tongue 1111 having the quadrangular configuration is cut at three sides thereof to allow the proximal end 1111*b* thereof to remain integrated with the strap 1, the strength of the strap 1 at the release prevention tongue 1111 is 1.2 to 1.5 greater than the case in which the release prevention tongue 1111 is completely removed from the strap 1.

While it was described in the present embodiment that the release prevention tongue 1111 is cut to have a distal end facing the strap entrance 24, it is to be readily understood that the release prevention tongue 1111 may be cut to have a distal end facing the strap exit 25. In the latter case, the distal end 1111*a* of the release prevention tongue 1111 is introduced into the window 22 of the locking head 2 and thus is capable of colliding against an inner front wall 22*b* of the locking head 2 which defines the window 22.

The operation of the ball type cable tie having a release prevention tongue according to the present invention, constructed as mentioned above, will be described in detail.

In the cable tie A according to the present invention, the release prevention tongue 1111 formed on the upper portion 111 of the fixed end 11 of the strap 1 is bent downward and the latching finger 1112 formed on the lower portion 112 of the fixed end 11 of the strap 1 is bent upward. When coupling the locking head 2 to the fixed end 11 of the strap 1, as the bottom wall 21 of the locking head 2 is fitted into the space defined between the upper and lower portions 111 and 112 of the fixed end 11 of the strap 1, the release prevention tongue 1111 and the latching finger 1112 of the strap 1 are introduced into the window 22 which is defined in the bottom wall 21 of the locking head 2. At this time, since the gap W1 between the distal end 1111*a* of the release prevention tongue 1111 and the distal end of the latching finger 1112 is less than the thickness of the bottom wall 21 of the locking head 2, the locking head 2 can be firmly coupled to the fixed end 11 of the strap 1 (see FIG. 3*a*).

Further, with the locking head 2 firmly secured to the fixed end 11 of the strap 1, when it is necessary to bundle the cables C, the free end 12 of the strap 1 is inserted through the strap entrance 24 of the locking head 2 and is discharged through the strap exit 25. While the strap 1 is pulled through the strap entrance 24 and the strap exit 25 to tightly bundle the cables C, the locking ball 3 is moved forward and is held such that it is brought into contact with the engagement arm 26 of the ball guide projection 23. When the cables C are tightly bundled, if the strap 1 is released, as the strap 1 is slightly withdrawn and the locking ball 3 is moved rearward in the ball guide projection 23, the locking ball 3 squeezes a portion of the strap 1, as a result of which the release prevention tongue 1111 formed on the upper portion 111 of the fixed end 11 of the strap 1 is pressed downward (see FIG. 3*b*). Therefore, as the locking ball 3 is moved rearward along the slope of the release prevention tongue 1111, the locking ball 3 tightens the strap 1. Also, as an elastic reaction force is generated in the release prevention tongue 1111 to push upward a portion of the strap 1 which is positioned on the release prevention tongue 1111, the locking ball 3 is sandwiched between the strap 1 and the ball guide projection 23 and is prevented from being released or moved forward, whereby it is possible to more tightly lock the cable tie A.

As described above, the release prevention tongue 1111 is not removed from the strap 1. That is to say, one end of the release prevention tongue 1111 remains integrated with the strap 1, and the remaining portion of the release prevention tongue 1111 is cut to a width of about 0.1 mm. The strength of the strap 1 at the release prevention tongue 1111 increases 1.2 to 1.5 times when compared to the case in which the release prevention tongue 1111 is completely removed from the strap 1, thereby improving locking ability and durability of the cable tie A.

As apparent from the above description, the cable tie according to the present invention comprises a band-shaped strap which has a fixed end formed in the shape of a hook and a free end, a locking head which is secured to the fixed end of the strap and through which the free end of the strap passes, and a locking ball which is disposed in the locking head and may be moved forward and rearward, wherein the width between upper and lower portions of the fixed end of the strap is established to be slightly greater than the thickness of the bottom wall of the locking head, a release prevention tongue is formed by being cut in the upper portion of the fixed end of the strap to be integrated with the strap, and a proximal end of the release prevention tongue is bent downward, whereby the locking head is reliably secured to the strap and is prevented from being released, and wherein the locking ball is guided in a rearward locking direction and is elastically supported upward to reliably ensure the locked state of the cable tie and reinforce the strength of the strap 1.2 to 1.5 times when compared to the case in which the release prevention tongue is removed from the strap to leave an aperture in the strap, thereby improving locking ability and durability of the cable tie.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A cable tie comprising:

a locking head having an inner rear wall, an inner front wall, and a bottom wall; the bottom wall having a window; the locking head having a strap entrance and a strap exit;

a band-shaped elongate strap having a fixed end and a free end; the fixed end being in the shape of a hook; the fixed end having an upper portion and a lower portion; the fixed end having the locking head secured thereon;

a release prevention tongue being cut in the upper portion of the fixed end and being integral with the strap; the release prevention tongue having a proximal end and a distal end; the proximal end facing the strap exit and the distal end facing the strap entrance; the proximal end being integrated with the strap and a distal end being cut from the strap to serve as a free end; the proximal end being bent downward toward the strap entrance so that the distal end is capable of being introduced into the window and being urged against an inner rear wall of the locking head;

a latching finger being cut in the lower portion of the fixed end and being capable of being introduced into the window; the latching finger having a proximal end and a distal end; the proximal end facing the strap exit and the distal end facing the strap entrance; the proximal end being integrated with the strap and a distal end being cut from the strap to serve as a free end; the proximal end being bent upward toward the strap entrance so that the distal end is capable of being introduced into the window; and, a locking ball positioned between the locking head and the strap.

2. The cable tie according to claim 1, wherein the release prevention tongue has a quadrangular configuration.

3. The cable tie according to claim 1, wherein the release prevention tongue has a rounded configuration or a triangular configuration.

* * * * *